US005820352A

United States Patent [19]

Gunn et al.

[11] Patent Number: 5,820,352

[45] Date of Patent: Oct. 13, 1998

[54] METHOD FOR CONTROLLING COMPRESSOR DISCHARGE PRESSURE

[75] Inventors: John T. Gunn, Charlotte; William H. Harden, Yadkinville; Don John Gerhardt, Clemmons, all of N.C.

[73] Assignee: Ingersoll-Rand Company, Woodcliff Lake, N.J.

[21] Appl. No.: 823,782

[22] Filed: Mar. 24, 1997

[51] Int. Cl.[6] ..... F04B 49/00

[52] U.S. Cl. ..... 417/53; 417/26; 417/29; 417/34; 417/295; 417/310

[58] Field of Search ..... 417/26, 29, 34, 417/53, 295, 310, 364; 418/201.1

[56] References Cited

U.S. PATENT DOCUMENTS

| | | | |
|---|---|---|---|
| 3,957,395 | 5/1976 | Ensign | 417/29 |
| 4,147,475 | 4/1979 | Shoop et al. | 417/310 |
| 4,218,191 | 8/1980 | Stewart . | |
| 4,330,237 | 5/1982 | Battah . | |
| 4,330,238 | 5/1982 | Hoffman | 417/34 |
| 4,516,914 | 5/1985 | Murphy et al. | 417/310 |
| 4,526,513 | 7/1985 | Bogel . | |
| 4,807,150 | 2/1989 | Hobbs . | |
| 4,975,024 | 12/1990 | Heckel . | |
| 4,976,588 | 12/1990 | Heckel . | |
| 5,067,326 | 11/1991 | Alsenz . | |
| 5,318,151 | 6/1994 | Hood et al. | 417/295 |
| 5,540,558 | 7/1996 | Harden et al. . | |
| 5,642,989 | 7/1997 | Keddie | 417/310 |

*Primary Examiner*—Timothy Thorpe
*Assistant Examiner*—Ted Kim
*Attorney, Agent, or Firm*—Michael M. Gnibus

[57] ABSTRACT

A method for controlling compressor discharge pressure in a compressor. The compressor comprising a compression module driven by a prime mover, the compression module having a discharge port through which a compressed fluid is discharged with a discharge pressure, and an inlet through which uncompressed fluid is flowed into the compression chamber, the flow of fluid through the inlet controlled by an inlet valve repositionable by an actuator driven by a motor. The method comprising the steps of running a discharge pressure control routine, comprising the steps of: calculating the difference between the actual discharge pressure and a predetermined setpoint discharge pressure; computing the required change in valve position to achieve the setpoint discharge pressure, the period of time the motor means must be energized to produce the change in valve position, and the direction the valve must be moved to produce the setpoint discharge pressure. The method including the additional steps of running an actuator position control routine, comprising the steps of: energizing the motor in the required direction for the computed period of time; and braking the motor by energizing the motor in a direction different than the required direction for a braking time interval.

21 Claims, 14 Drawing Sheets

METHOD FOR CONTROLLING COMPRESSOR DISCHARGE PRESSURE

BACKGROUND OF THE INVENTION

The invention relates to a method for controlling compressor discharge pressure either by controlling the speed of the compressor prime mover or by repositioning the compressor inlet valve.

Control systems for compressors typically use pneumatically or mechanically actuated devices to control compressor components such as compressor inlet valves for example. Such devices control the position of the inlet valve so that the required volume of fluid is supplied to the compressor.

Compressors and the associated compressor control devices are designed to be operated in a single ambient operating temperature range such as −20° to 115° F. When the compressor is operated in ambient temperatures within the ambient operating temperature range, the compressor operates in an efficient manner and the pneumatic and mechanical compressor control devices usually operate as required. However, when the compressor is operated outside the ambient operating temperature range, such as in extremely cold or hot conditions, the pneumatically and mechanically actuated control devices frequently do not operate as required and the efficiency of the compressor is significantly reduced. Running the compressor at a reduced efficiency, reduces the life of the compressor bearings, increases compressor noise and vibration and can significantly increase the frequency of compressor repairs. Additionally, the useful life of the compressor may be greatly decreased as a result of use of known pneumatic and mechanically actuated compressor control devices.

There are additional shortcomings associated with using pneumatic and mechanical controls in portable compressors. Because pneumatic and mechanical devices are comprised of a large number of discrete component parts and because such devices rely on fluid flow through the devices for efficient operation, the control devices frequently do not operate properly even when the compressor is operated in the designed ambient operating temperature range. The component parts may stick or freeze in cold temperatures near freezing. Also, pneumatically and mechanically actuated compressor control devices have a limited useful life and, over time, component parts wear out and must be repaired or replaced. Not only is reliability of known control devices low, the cost to repair and maintain known control devices can be quite high.

Compressor lubricant supply valves, flow conduits etc. through which compressor lubricant is flowed to the compression module, are designed for a lubricant at a specific viscosity. Accordingly, in order to achieve controlled flow of the compressor lubricant through the compressor it is highly desirable to maintain the viscosity of the compressor lubricant substantially constant at the specific design viscosity. Known compressors do not maintain the lubricant at the required viscosity to achieve controlled lubricant flow.

Also, in conventional compressors, neither the speed of the prime mover nor the position of the compressor inlet valve may be changed independent of the other compressor operating parameter. The inlet valve could not be opened or closed without also increasing or decreasing the prime mover speed. This rigid interrelation between inlet valve position and prime mover speed limits a compressor operator's ability to obtain the desired compressor discharge pressure.

The foregoing illustrates limitations known to exist in present devices and methods. Thus, it is apparent that it would be advantageous to provide an alternative to thereby overcome one or more of the limitations set forth above. Accordingly, a suitable alternative is provided including features more fully disclosed hereinafter.

SUMMARY OF THE INVENTION

In one aspect of the present invention, this is accomplished by providing a method for controlling compressor discharge pressure in a compressor. The compressor comprising a compression module driven by a prime mover, the compression module having a discharge port through which a compressed fluid is discharged with a discharge pressure, and an inlet through which uncompressed fluid is flowed into the compression chamber, the flow of fluid through the inlet controlled by an inlet valve repositionable by an actuator driven by a motor. The method comprising the steps of running a discharge pressure control routine, comprising the steps of: calculating the difference between the actual discharge pressure and a predetermined setpoint discharge pressure; computing the required change in valve position to achieve the setpoint discharge pressure, the period of time the motor means must be energized to produce the change in valve position, and the direction the valve must be moved to produce the setpoint discharge pressure. The method including the additional steps of running an actuator position control routine, comprising the steps of: energizing the motor in the required direction for the computed period of time; and braking the motor by energizing the motor in a direction different than the required direction for a braking time interval.

The foregoing and other aspects will become apparent from the following detailed description of the invention when considered in conjunction with the accompanying drawing figures.

DESCRIPTION OF THE DRAWING FIGURES

Figure 4:
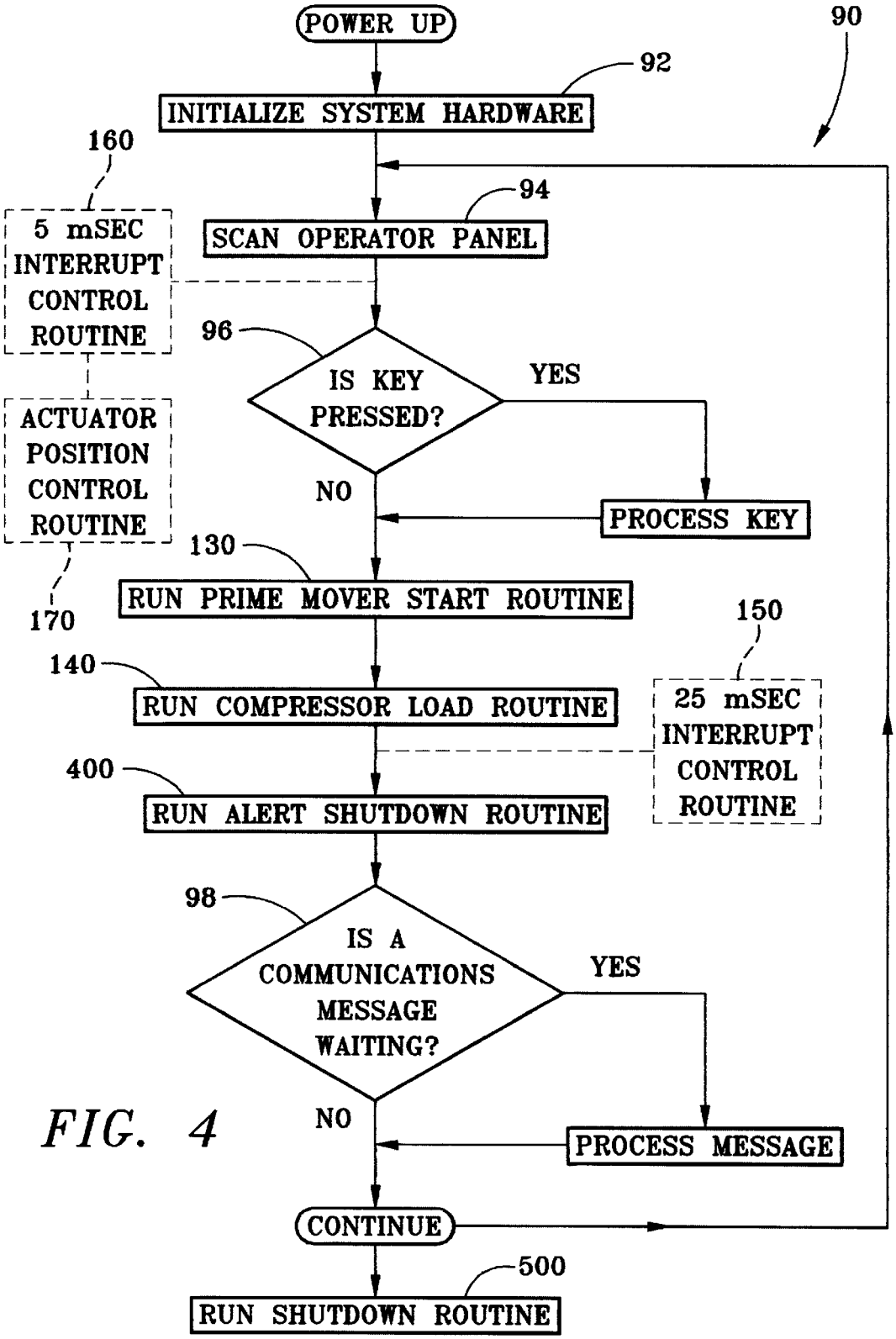
FIG. 4 is a flowchart illustrating the logic for the main logic routine of the compressor control system.
Figure 12:
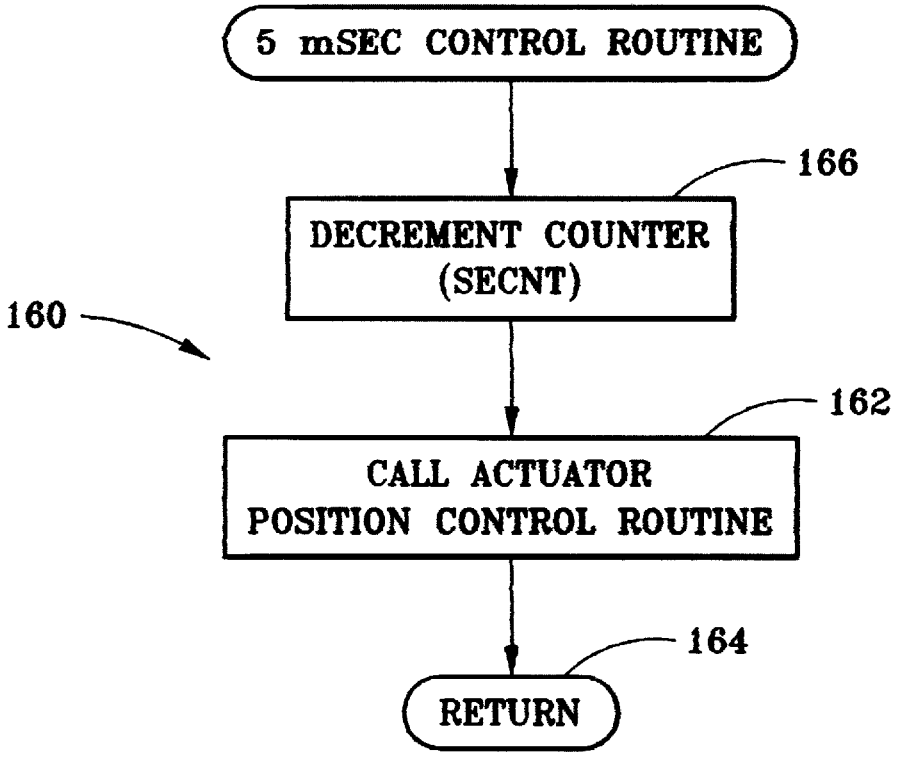
Figure 13:
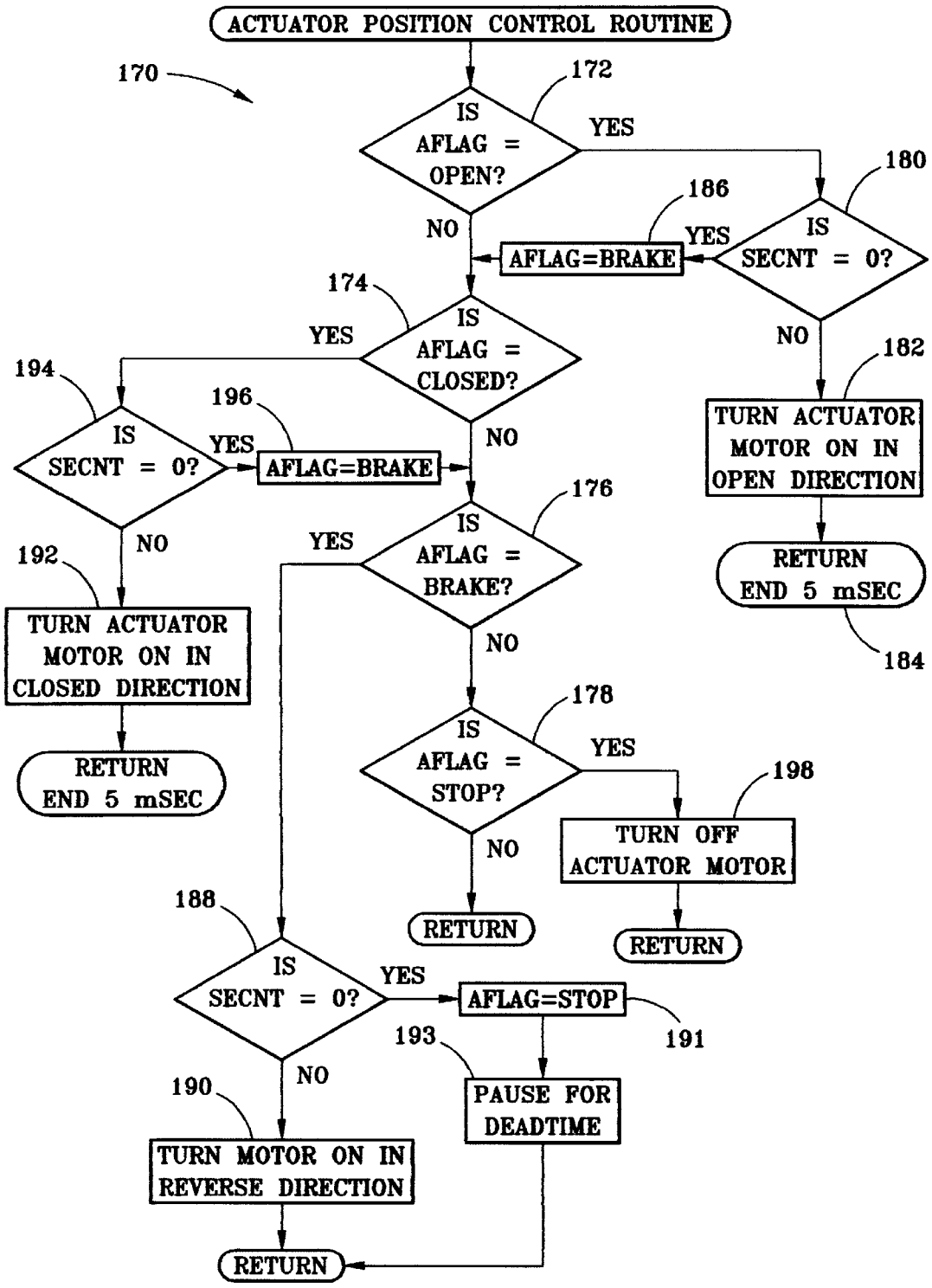

FIG. 12 is a flowchart illustrating the 5 millisecond control routine identified as step 160 in FIG. 4; and FIG. 13 is a flowchart illustrating the actuator position control routine identified as step 170 in FIG. 4.

DESCRIPTION OF THE PREFERRED EMBODIMENT

Figure 1:
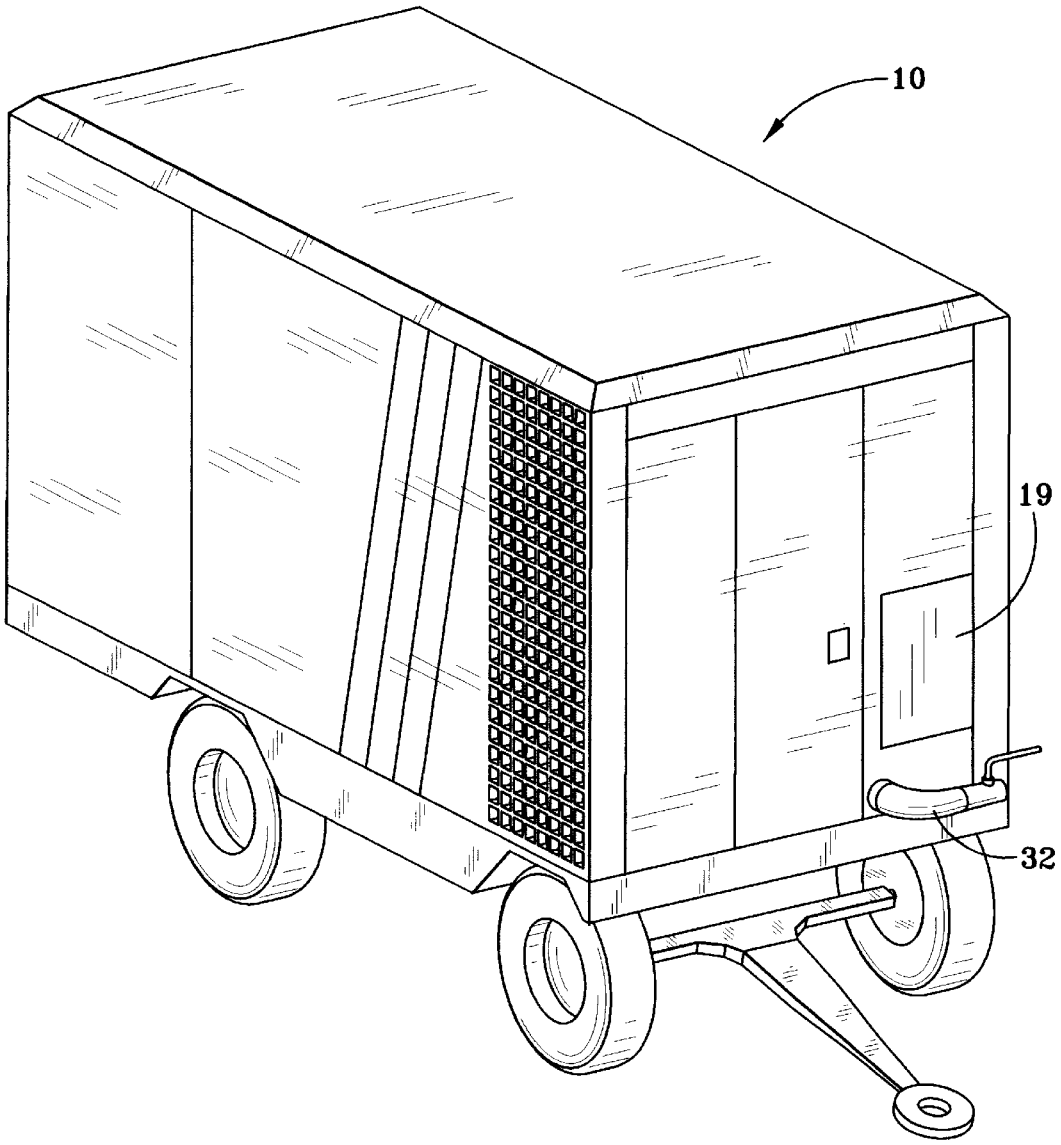
FIG. 1 is an isometric view of a portable compressor that includes the compressor control system of the present invention.

Turning now to the drawings wherein like compressor components and compressor controller logic steps are referred to by the same number throughout the several views, FIG. 1 shows an isometric view of a portable compressor 10 that includes the compressor control system 40 of the present invention. The compressor control system electronically monitors and controls the startup, operation, and shutdown of the compressor.

The compressor includes a display control panel 60 (described in detail hereinbelow) which is protected from harmful dirt and debris by panel door 19. The door is hingeably connected to the compressor body and may be opened and closed by a compressor operator as required. Discharge valve 32 extends outward from the compressor housing.

Figure 2:
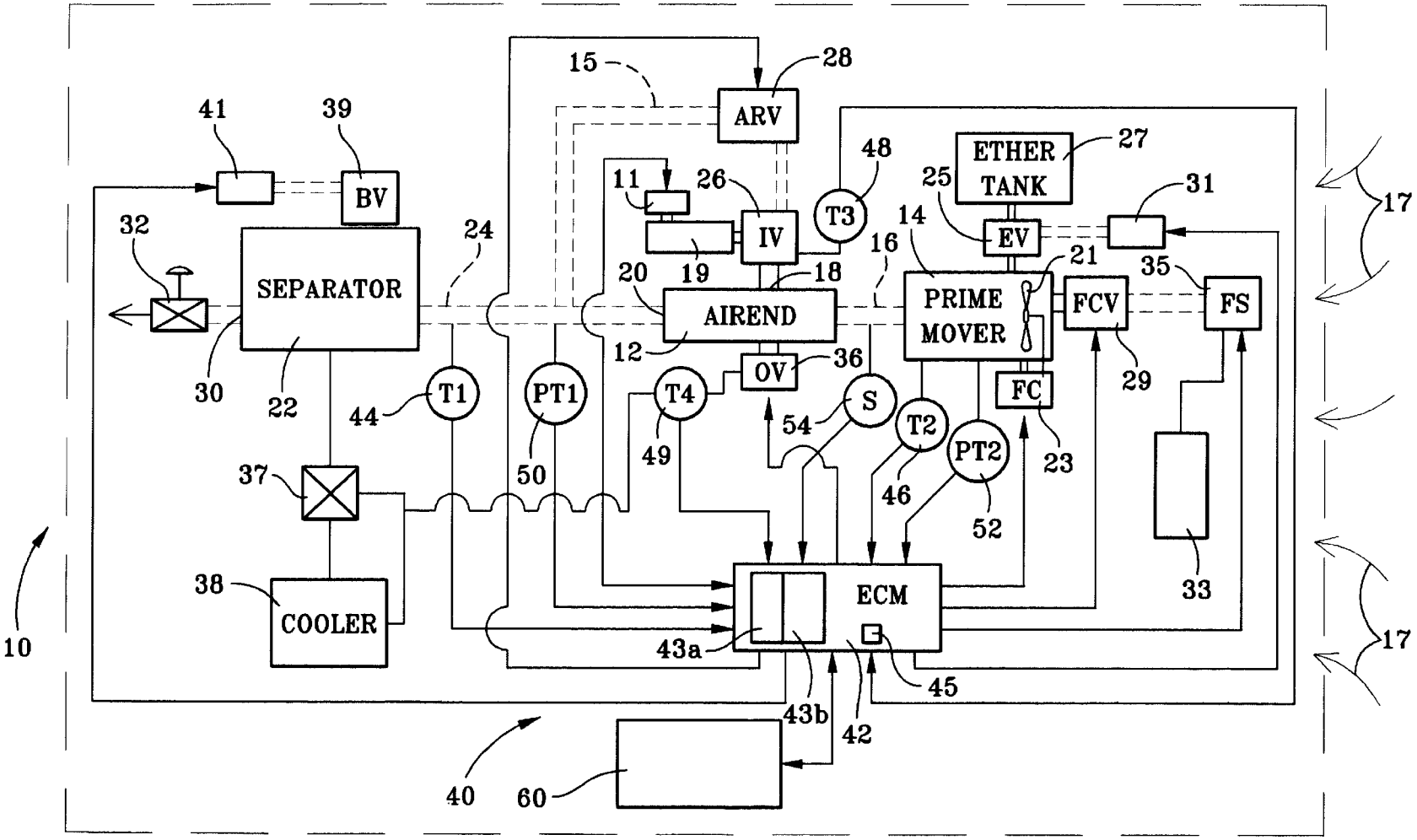
FIG. 2 is a schematic representation of the portable compressor of FIG. 1.

With the exception of the control system, the compressor 10 is of conventional design well known to one skilled in the art, and includes a compression module or airend 12 that is driven by a prime mover 14 which includes an output shaft (not shown) which in turn is operably connected to the compression module by coupling 16 shown schematically in FIG. 2. The prime mover produces rotary motion that is outputted through the output shaft and coupling to drive the airend. The airend, prime mover and coupling are all well known to one skilled in the art. For purposes of describing the preferred embodiment of the invention, the compression module or airend 12 is an oil-flooded rotary screw type airend with male and female interengaging rotors (not shown), and the prime mover 14 is a diesel engine. However, it should be understood that the airend 12 may be an oilless rotary screw type airend and the prime mover may be a spark ignition engine.

The airend has an inlet port 18 and a discharge port or outlet 20, shown schematically in FIG. 2. The prime mover includes a fan 21 which draws fluid such as ambient air into the compressor package in the direction of arrows 17. The fan 21 is preferably operably connected to a fan clutch "FC", referred to at 23, which is used to alter the speed of the fan. Ether valve "EV", referred to at 25 flow connects ether supply tank 27 to prime mover 14. The ether supply tank contains a volume of ether that may be flowed into the prime mover through ether valve 25 as required, to help start the compressor prime mover. An ether valve solenoid 31 is operably connected to the valve 25 and opens and closes the ether valve in a conventional manner.

A prime mover fuel control valve "FCV" referred to at 29 is flow connected to a fuel solenoid valve "FS", 35 which in turn is flow connected to a suitable fuel supply tank 33. During operation of compressor 10, the volume of fuel supplied to the prime mover is precisely controlled by the FCV. The fuel solenoid is a main supply valve which generally opens or closes the flow of fuel from the supply tank 33 to the FCV. The FS is closed when the prime mover is shut down and is open when the prime mover is operating. By increasing or decreasing the volume of fuel supplied to the prime mover through the FCV, the rotational speed of the prime mover 14 is likewise increased or decreased.

For purposes of clarity, the term "fluid" shall mean any gas, or liquid. The term "parameter" shall mean any condition, level or setting for the compressor. Examples of compressor operating parameters include discharge pressure, discharge fluid temperature, and prime mover speed. Additionally, the terms "lubricant" and "coolant" as used herein shall mean the fluid that is supplied to the compression module and mixed with the compressible fluid during compressor operation.

An inlet valve "IV" referred to at 26, is flow connected to the inlet 18 of airend 12 and antirumble valve "ARV" referred to at 28, is flow connected to the inlet valve. The inlet valve is described in U.S. Pat. No. 5,540,558 which is incorporated herein by specific reference. As described in detail in the '558 patent, the inlet valve precisely controls the volume of gas flowed to the airend through inlet 18, and prevents backflow through the inlet valve. The inlet valve uses a linear actuator 19 driven by a conventional DC motor with brushes 11, to precisely position the inlet valve. The motor is in electronic pulse receiving relation with the electronic control module 42.

A lubricant such as oil is supplied to the airend through lubricant valve "OV", referred to at 36. The lubricant valve 36 is flow connected to a lubricant cooler 38 which in turn is flow connected to separator 22. A thermal relief valve 37 is connected to the flow line that connects the separator 22 and cooler 38.

As the inlet gas, such as air for example, is flowed into compression module 12 through the inlet valve 26 and inlet 18, a lubricant such as oil is injected into the compression chamber of airend 12, and is mixed with the fluid during compression. The mixture of compressed gas and lubricant is then flowed out the compressor discharge port 20 through flow line 24 and into a conventional separator tank 22 which is flow connected in mixture receiving relation with the airend 12 by the flow line 24. The separator serves to substantially separate the lubricant from the compressed gas. The substantially lubricant-free compressed gas is flowed from the separator tank outlet 30 through compressor discharge valve 32 to an object of interest such as a pneumatic tool for example. The separated lubricant is collected in separator tank 22 and cooled by flow through the lubricant cooler 38.

Blowdown valve, "BV", referred to at 39 is also flow connected to the separator tank. The blowdown valve is typically closed during compressor operation and is only opened when the compressor is shutdown, to reduce the pressure in the separator tank 22. Opening and closing of the blowdown valve is controlled by blowdown valve solenoid 41.

Compressor Control System

During operation of compressor 10, the compressor control system generally indicated at 40 in FIG. 2, continuously monitors values of a number of key compressor operating parameters sensed by associated sensors; and compares the sensed values of the key parameters to predetermined set point parameter values. If at least one of the operating parameters is not at the respective set point parameter value, the orientation, position, speed or other operating parameter of the compressor component(s) which affect the parameter value is precisely controlled electronically by the control system. In this way, the compressor control system maintains the parameter values required to maximize compressor operating efficiency and produce the required discharge pressure.

The compressor control system includes an electronic control module or "ECM" referred to at 42 in FIG. 2. The ECM is programmed to include a logic routine illustrated generally in flowchart FIGS. 4–13. The ECM logic routine is comprised of a main logic routine or loop identified at 90 in FIG. 4, and a number of subroutines or loops 130, 140, 150, 160, 170, 400, and 500. The logic routine compares actual, sensed compressor operating parameters to predetermined corresponding setpoints for the operating parameters to ensure that the compressor is operating properly and efficiently. The setpoint values are stored in ECM memory 43*a*. If the ECM determines that the compressor is not running as required, the operation of the compressor is adjusted by the ECM routine. The ECM logic illustrated generally in FIGS. 4–13 will be described in greater detail hereinbelow.

In general, the ECM is a microprocessor-based system with memory comprised of volatile and non-volatile memory identified respectively at 43*a* and 43*b* in FIG. 2. The ECM rapidly and continuously executes the main software control loop 90. The ECM includes an interrupt counter 45 that measures the time intervals between operation of interrupt control routines 150 and 160. The execution of the main control loop is interrupted every 25 milliseconds, msec, to execute an interrupt control loop 150 shown in dash font in FIG. 4; and is interrupted every 5 msec to execute interrupt control loop 160 also represented in dashed font in FIG. 4. The ECM is provided with the conventional latches and drivers required to support the Input/Output functions; to drive motors, solenoids and alarms; and to process inputs from pressure transducers, temperature transducers, level transducers, speed transducers and digital inputs.

The electronic control module 42 is in signal receiving relation with a number of sensors which sense compressor operational parameters such as temperatures and pressures and supply the values to the ECM. Additionally, the ECM is in signal transmitting relation with a number of the control valves and fan clutch 23 of compressor 10. The ECM sends signals to the inlet valve motor 11. In FIG. 2, the communication link between the ECM and the respective sensor, valve, and clutch is shown schematically in the form of a lead line with an arrowhead at one end of the lead line showing the direction of signal communication.

Referring to FIG. 2, the compressor control system 40 includes first, second, third, and fourth temperature sensors 44, 46, 48, and 49. First temperature sensor or "T1", is located between airend discharge port 20 and separator 22 along flow line 24 and senses the temperature of the compressed fluid flowed out of the discharge port. The second temperature sensor or "T2" senses the temperature of the prime mover coolant that is circulated through the prime mover during operation thereof. The third temperature sensor or "T3" is located at the airend inlet valve 26 and senses the temperature of the uncompressed fluid that is flowed into the airend 12. The fourth temperature sensor or "T4" senses the temperature of the lubricant that is mixed with the fluid as the fluid is compressed in airend 12.

The system 40 also includes two pressure sensors 50 and 52, and a prime mover speed sensor 54 identified respectively as "PT1", "PT2", and "S" in FIG. 2. The first pressure sensor 50 is located along flowline 24 proximate discharge port 20, and senses the pressure of the compressed gas discharged from the airend 12. The second pressure sensor 52 senses the pressure of the prime mover lubricant. Speed sensor 54 is located on the prime mover and senses the rotational speed of the prime mover flywheel (not shown) during operation of the prime mover.

As shown schematically in FIG. 2, first, second, third, and fourth temperature sensors 44, 46, 48, and 49, first and second pressure sensors 50 and 52, and speed sensor 54 are electrically connected to the ECM 42; are in signal transmitting relation with the ECM; and send signals corresponding to the associated sensed compressor operating parameters to the ECM which processes the signals.

Figure 3:
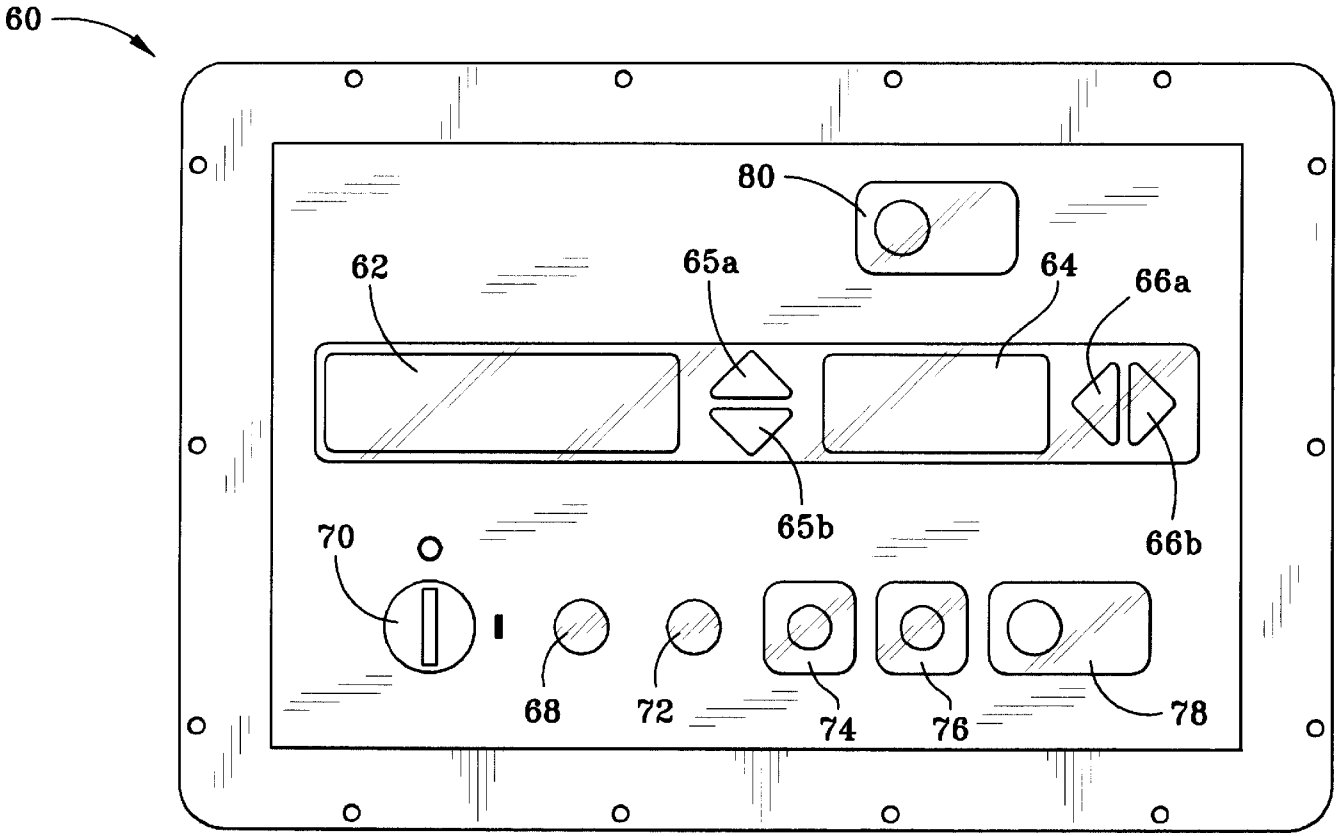
FIG. 3 is a front view of a diagnostic control panel for the compressor of FIG. 1.

The ECM is electrically connected to compressor control panel 60 and receives signals from and sends signals to the panel. Instructions and messages transmitted from the ECM are displayed for viewing by a compressor operator in LCD alpha numeric format in display window 62, shown in FIG. 3. In response to the instructions and messages displayed in the window 62, the compressor operator can make the required changes to compressor operating parameters by entering setpoint parameter values in display window 64. Like window 62, the parameters are displayed in window 64 in a readable, LCD numeric format. The compressor operator can scroll through parameter menus that appear in the window 64 via up and down scroll keys 65*a* and 65*b*, can select a parameter value using select key 66*a*, and can return to a previous menu using return key 66*b*. Additionally, the return key 66*b* is used to store parameter setpoint values in the ECM memory 43*a*. For example, when a compressor parameter value is scrolled to using the scroll keys 65*a* and 65*b*, and modified from the menu, the value is stored in the ECM memory by actuating the return key 66*b*.

The panel 60 includes a compressor control system on/off switch 70 which supplies and terminates power to the ECM, sensors and diagnostic panel of system 40. Ether may be injected into prime mover 14 by actuating ether injection switch 72. The compressor is started and stopped by switches 74 and 76, respectively.

When compressor 10 is fully loaded, the "loaded" indicator 78 is illuminated indicating to the operator that the compressor is ready for use. Indicator 78 will be described hereinbelow in conjunction with the description of the compressor load routine 140.

When a compressor operating parameter is outside an alert limit, hereinafter referred to as an "alert state", panel alarm indicator 80 is illuminated intermittently indicating to the operator that an alert state exists. In an alert state, the compressor continues to operate and a message is provided temporarily on display 62 notifying the operator of the nature of the alert state.

When a compressor operating parameter is outside a shutdown limit, hereinafter referred to as a "shutdown state", the alarm indicator 80 is continuously illuminated and a message describing the nature of the shutdown state is permanently displayed in window 62.

The display windows 62 and 64 may be backlit by lights and panel 60 may be illuminated by an externally located light. When the compressor is operated in low lighting, the panel and displays may be illuminated by actuating light switch 68.

When the compressor is operated in direct sunlight or bright light, glare from the bright light on the display windows 62 and 64 is reduced by a coating applied to the display windows. The coating gives the display windows a darker, "smoked" appearance and eliminates the glare which would make reading the display windows difficult.

The control system on/off switch 70 is a conventional mechanical type switch, and the other panel switches are conventional membrane type switches all well known to one skilled in the art.

The Electronic Control Module (ECM)

The ECM is adapted for use with any suitable machine including but not limited to compressors, engines, and pumps for example.

The Electronic Control Module is a microprocessor-based controller and serves to efficiently control operation of compressor 10 by monitoring actual values of operating parameters for the compressor, comparing actual values with stored setpoint values for the parameters and precisely controlling operating compressor components to ensure that the parameters are maintained within acceptable setpoints. FIGS. 4–13 illustrate the logic routine that is stored in the programmed ECM memory 43*a*. The logic includes Main Control Routine 90 shown in FIG. 4; Prime Mover Start Routine 130 illustrated in FIG. 5; Compressor Load Routine 140 shown in FIG. 6; 25 msec Interrupt Control Routine 150 illustrated in FIG. 7; Prime Mover Speed Control Routine 300 illustrated in FIG. 8; Discharge pressure control Routine 200 illustrated in FIG. 9; Alert/Shutdown Routine 400 illustrated in FIG. 10; Compressor Shutdown Routine 500 illustrated in FIG. 11; 5 msec Interrupt Control Routine illustrated in FIG. 12; and Actuator Position Control Routine 170 shown in FIG. 13. The subroutines 130, 140, 150, 160, 170, 200, 300, 400, and 500 will be described in greater detail hereinbelow.

In routine 90, initially when the control system is powered up, all of the system sensors and other hardware including switches and transducers are initialized in step 92 and at the conclusion of step 92, a message is displayed in control panel window 62 indicating to the compressor operator that the compressor is ready for use. During both initial prime mover startup and continuously during compressor operation, the routine 90 scans the control panel 60 in step 94 to determine if any control panel buttons have been pressed or operating parameter values have been inputted by the operator. See steps 94 and 96. After the routine determines the start button 74 has been pressed, the prime mover start routine 130 is executed.

Prime Mover Start Routine

Figure 5:
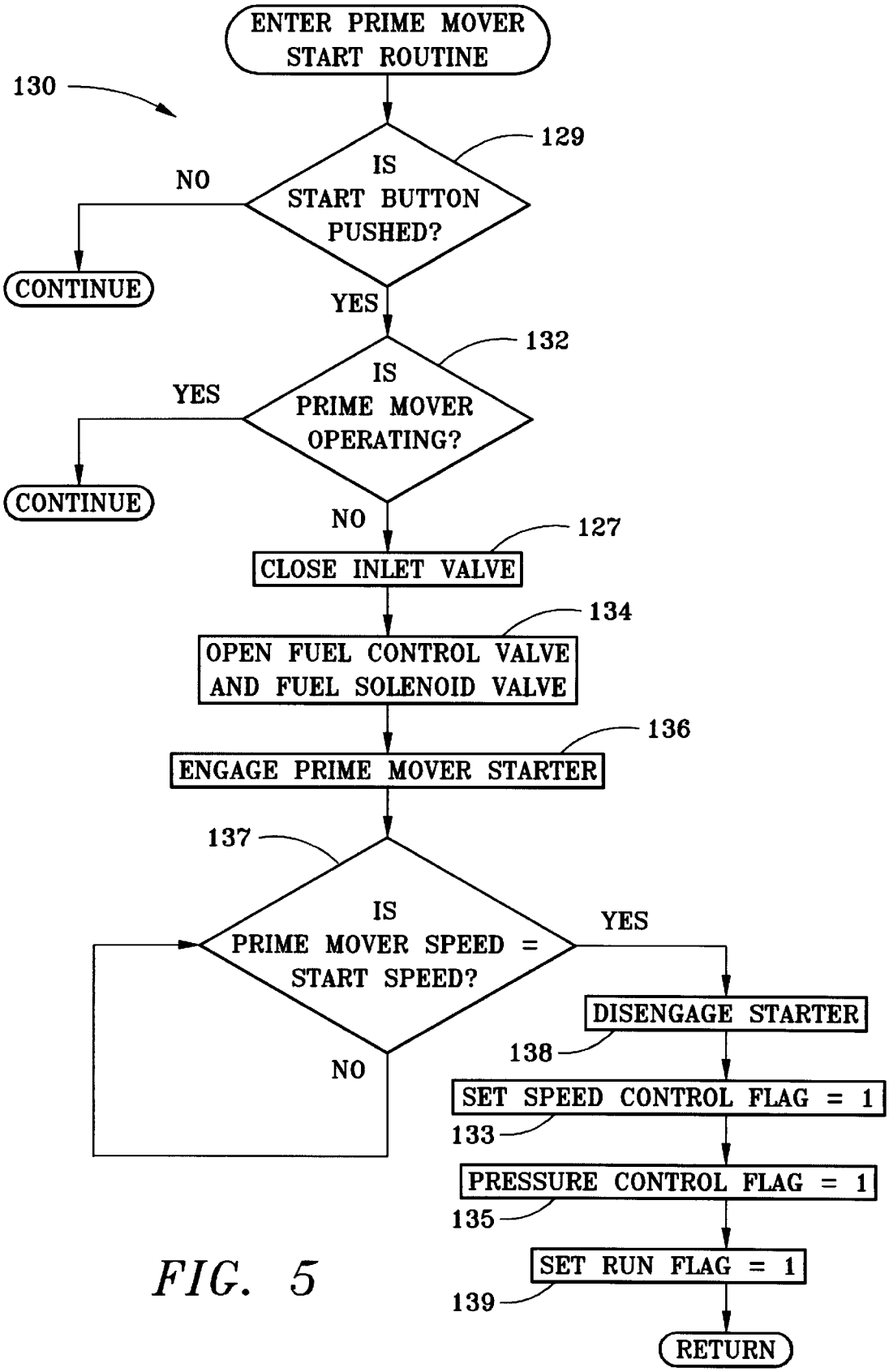
FIG. 5 is a flowchart illustrating the prime mover start routine, identified as step 130 in the flowchart of FIG. 4.

The prime mover start routine is flowcharted in FIG. 5 and is identified at 130.

Initially, in step 129 if the start button 74 on control panel 60 has been pushed and in step 132, if speed sensor 54 senses that prime mover 14 is not operating, in step 127, the inlet valve 26 is closed and in step 134 the fuel solenoid valve 35 and fuel control valve 29 are fully opened to permit fuel to be supplied to the prime mover from fuel supply reservoir 33. By fully opening valves 29 and 35, a maximum volume of fuel may be supplied to the prime mover during initial prime mover acceleration. The solenoid valve remains fully opened during compressor operation, and is closed when the compressor is shutdown. The position of the fuel control valve is controlled during operation. Closing the inlet valve prevents the compressor from being loaded until predetermined compressor loading operating conditions are realized.

In step 136, the prime mover is engaged by the prime mover starter (not shown) and once it is determined in step 137 that the prime mover is at a predetermined acceptable start speed, such as 600 rpm for example, the prime mover starter disengages the prime mover in step 138. Finally, in steps 133, 135, and 139 at the end of routine 130, a SPEED CONTROL FLAG, a PRESSURE CONTROL FLAG, and a RUN FLAG are each set equal to 1. By setting the SPEED CONTROL FLAG and PRESSURE CONTROL FLAG equal to 1, the prime mover speed control routine 300, and discharge pressure control routine 200 are executed during each 25 msec interrupt control loop 150. Prior to setting the SPEED CONTROL FLAG and PRESSURE CONTROL FLAG equal to 1, the routines 200 and 300 are not executed. Upon returning to routine 90, the compressor load routine 140 is automatically executed. There is no need for the operator to manually actuate the compressor load routine. Routine 90 executes the compressor load routine automatically after the prime mover achieves start speed.

Compressor Load Routine

Figure 6:
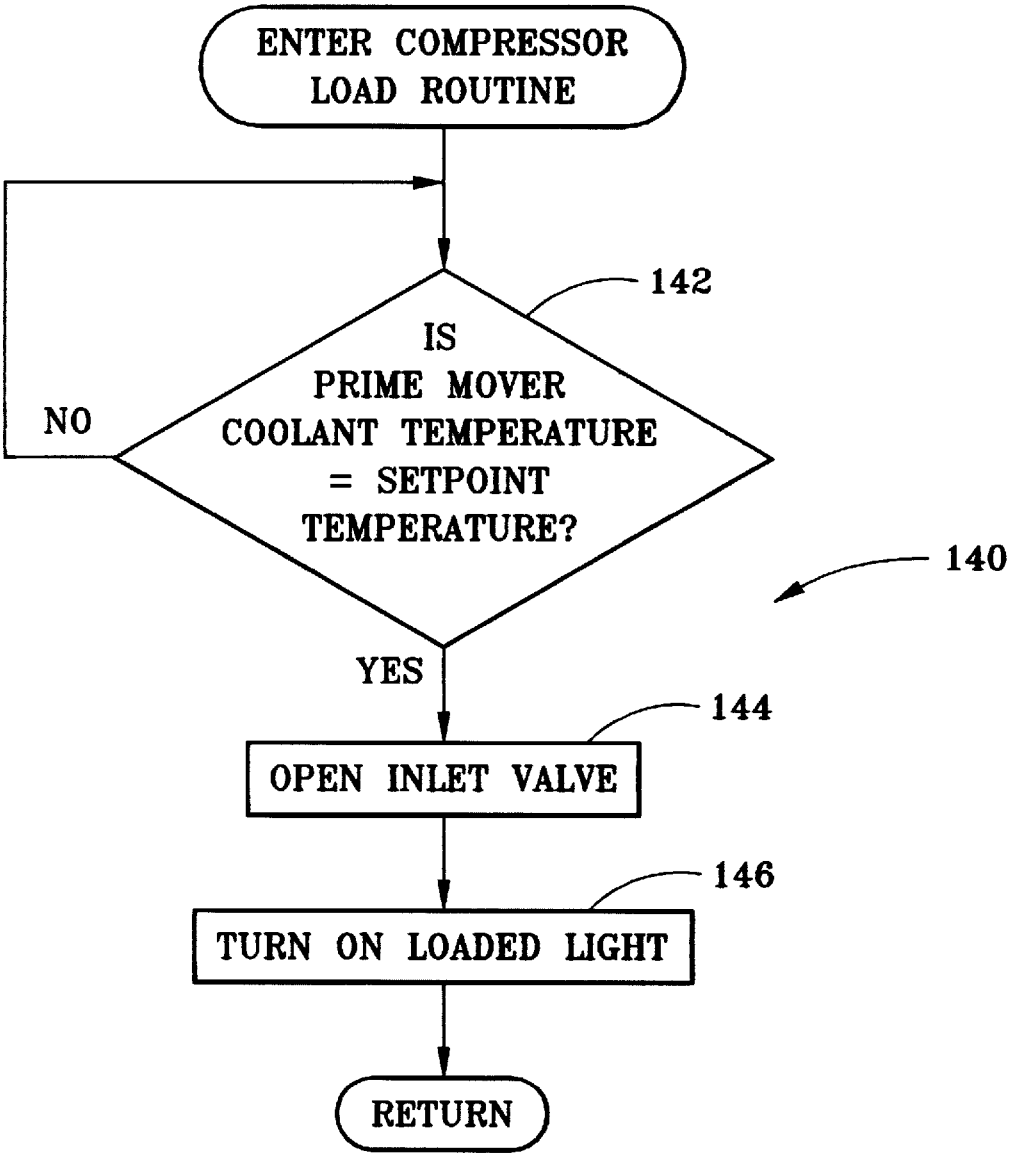
FIG. 6 is a flowchart illustrating the compressor load routine, identified as step 140 in the flowchart of FIG. 4.

The Compressor Load Routine 140 is flowcharted in FIG. 6. When the routine 90 enters the compressor load routine, the prime mover 14 is turning at idle speed (1200 rpm). In step 142, the prime mover maintains the idle speed as the temperature of the prime mover coolant sensed by temperature sensor 46 increases to the setpoint coolant temperature. The setpoint coolant temperature may be 90° F. for example. The routine 140 will not proceed past step 142 until the prime mover coolant temperature reaches the predetermined setpoint temperature stored in memory 43*a*. When the coolant temperature reaches the predetermined setpoint temperature in step 142, the ECM sends a signal to compressor inlet valve 26 and thereby opens the inlet valve, in step 144. After the inlet valve is opened and the compressor is at least substantially loaded to achieve the desired discharge pressure, step 146 is executed and the loaded light 78 on the control panel 60 is illuminated by the ECM.

Therefore, as a result of the compressor start routine 140, the compressor is loaded automatically after both the prime mover coolant temperature sensed by sensor 46, and prime mover speed sensed by sensor 54 are at predetermined setpoint values.

25 msec Interrupt Control Routine

Figure 7:
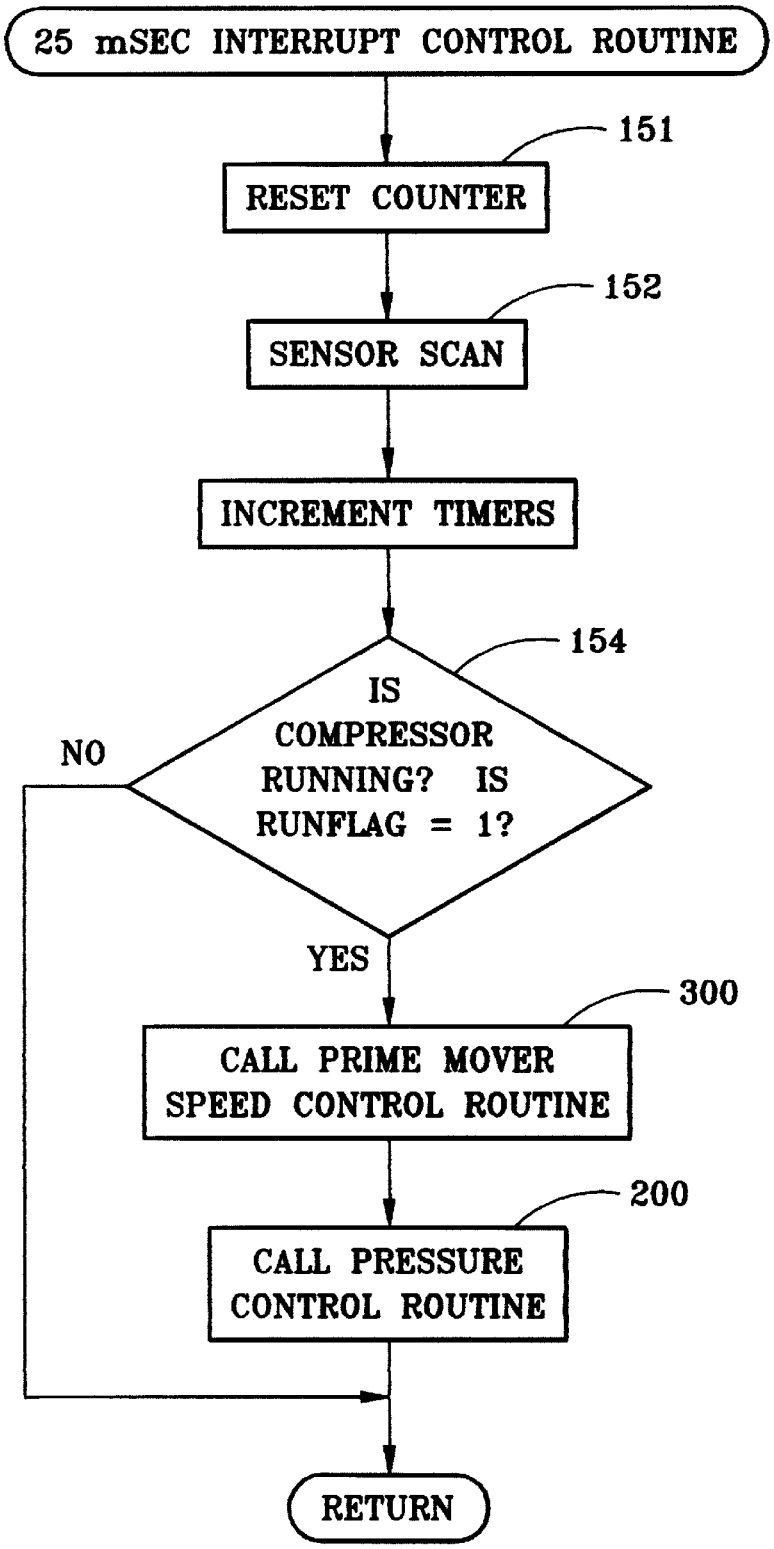
FIG. 7 is a flowchart illustrating the twenty-five millisecond interrupt control routine, identified as step 150 in the flowchart of FIG. 4.

Execution of main routine 90 is interrupted every twenty-five msec, at the expiration of interrupt counter 45, to execute interrupt control routine 150, flowcharted in FIG. 7. The routine 150 is represented in dashed font in FIG. 4 since the routine may be initiated at any point along the routine 90.

After resetting the counter in step 151 and scanning the sensors, switches and transducers in step 152, the routine determines whether the compressor is running by reading the value of RUN FLAG in step 154. If the compressor is not running, the routine 150 returns to routine 90. If the RUN FLAG value is 1, the compressor is running, and the routine then runs prime mover speed control routine 300 flowcharted in FIG. 8, and discharge pressure control routine 200 flowcharted in FIG. 9. As indicated hereinabove, routines 200 and 300 are only run if the associated FLAGS have been set to 1. After the routines 200 and 300 have been run the routine 150 returns to main routine 90.

When the sensor scan step 152 is initiated, temperature sensors 44, 46, 48, and 49; and pressure sensors 50 and 52 are scanned and the actual compressor operating values sensed by the sensors are obtained and are stored in the ECM memory 43*b*.

The sensor scan routine calculates a running average of the discharge pressure PT1 and the average slope of the discharge pressure PT1, where the slope is equal to the change in compressor discharge pressure per unit time. A numerical filtering technique, such as the least squares fit or a Butterworth filter is used to obtain the slope. The filtering technique is necessary because of the pressure pulsations that result from operation of a screw compressor.

The routine 150 is initiated every twenty-five msec however it should be understood that the frequency that the interrupt control routine is initiated may be increased or decreased as required.

Prime Mover Speed Control Routine

Figure 8:
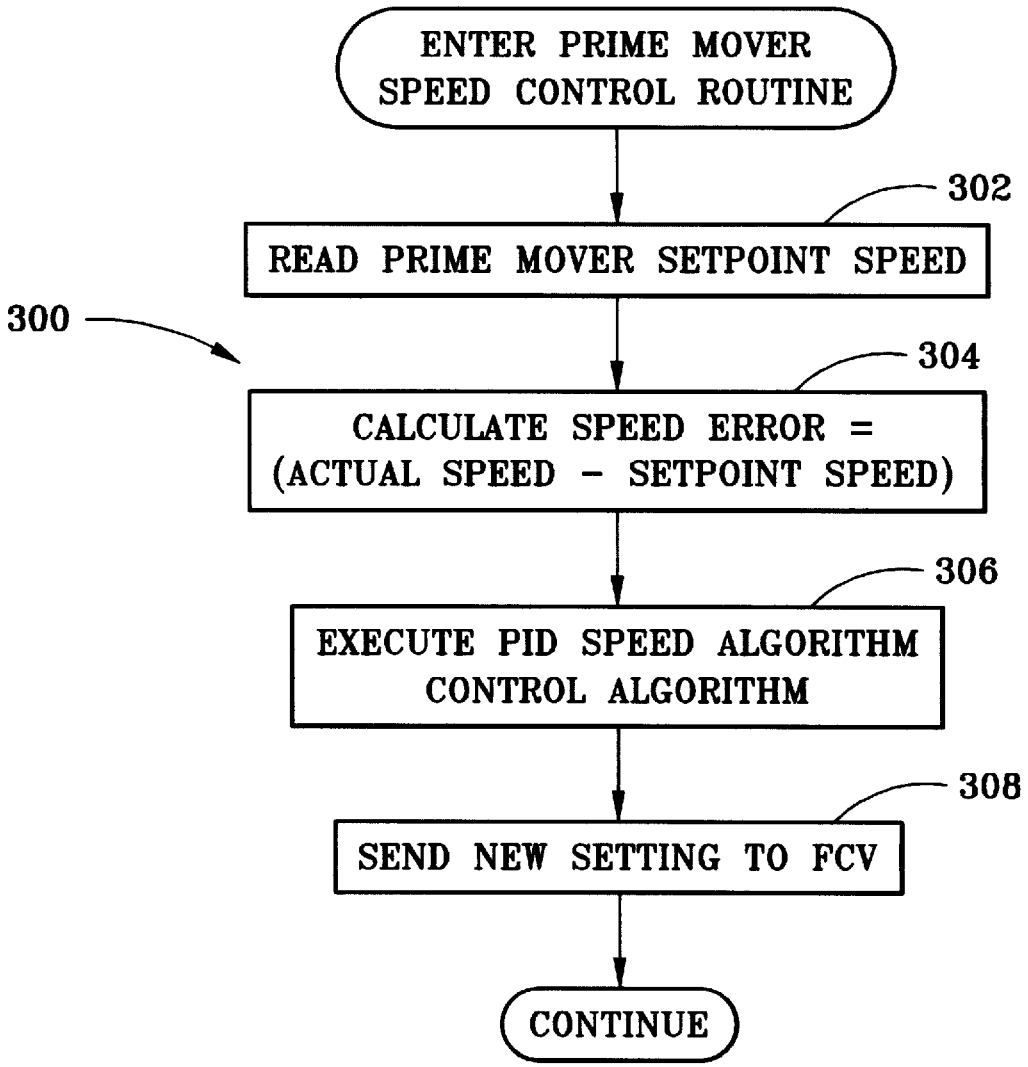
FIG. 8 is a flowchart illustrating the prime mover speed control routine, identified as step 300 in the interrupt control routine of FIG. 7.

If the SPEED CONTROL FLAG is set equal to 1, routine 300, flowcharted in FIG. 8 is executed. The rotational speed of the prime mover 14 is monitored by routine 300. Changing loads at airend 12 can affect the speed of the prime mover which in turn will affect the compressor discharge pressure.

The speed of the prime mover is adjusted to counteract the variable airend loads by adjusting the volume of fuel supplied to the prime mover through the fuel valve 29. In this way, the speed of the prime mover is not affected by the changing airend loads.

The prime mover speed is sensed using a magnetic pickup that sends a pulse signal to the ECM with each passing of a tooth on the flywheel ring gear. The routine uses the ECM crystal oscillation frequency to calculate the time period between pulses, and uses this information to calculate the speed of the prime mover. Since the speed of an internal combustion engine is oscillatory, due to torque pulses each time the engine fires, the prime mover speed is averaged over a predetermined number of tooth passings, 29 for example.

Initially in step 302, the prime mover setpoint speed stored in ECM memory 43*a* is read by the routine 300, and in step 304, the speed error is calculated by subtracting the setpoint speed from the actual speed value sensed as indicated hereinabove by speed sensor 54.

The calculated speed error is then used to execute a conventional proportional integral derivative ("PID") algorithm in step 306. The PID algorithm determines the fuel control valve setting required to obtain the prime mover setpoint speed. The PID could utilize either the absolute setting or incremental setting routines to determine the required FCV setting. However, it is preferred that the absolute setting routine be used so that a fuel control valve setting is calculated each time Routine 300 is executed.

After the PID algorithm is executed, and the new valve setting is calculated, a repositioning signal is sent to fuel control valve 29 in step 308 and as a result, the fuel control valve 29 is precisely repositioned as required to obtain prime mover speed within the predetermined setpoint speed. The new setpoint speed is stored in ECM memory.

Routine 300 then returns to interrupt control routine 150.

The prime mover speed control routine 300 causes the speed of the prime mover to be maintained when the prime mover speed would be otherwise increased or decreased due to fluctuations in the loading of compressor airend 12.

Discharge Pressure Control Routine

Figure 9A:
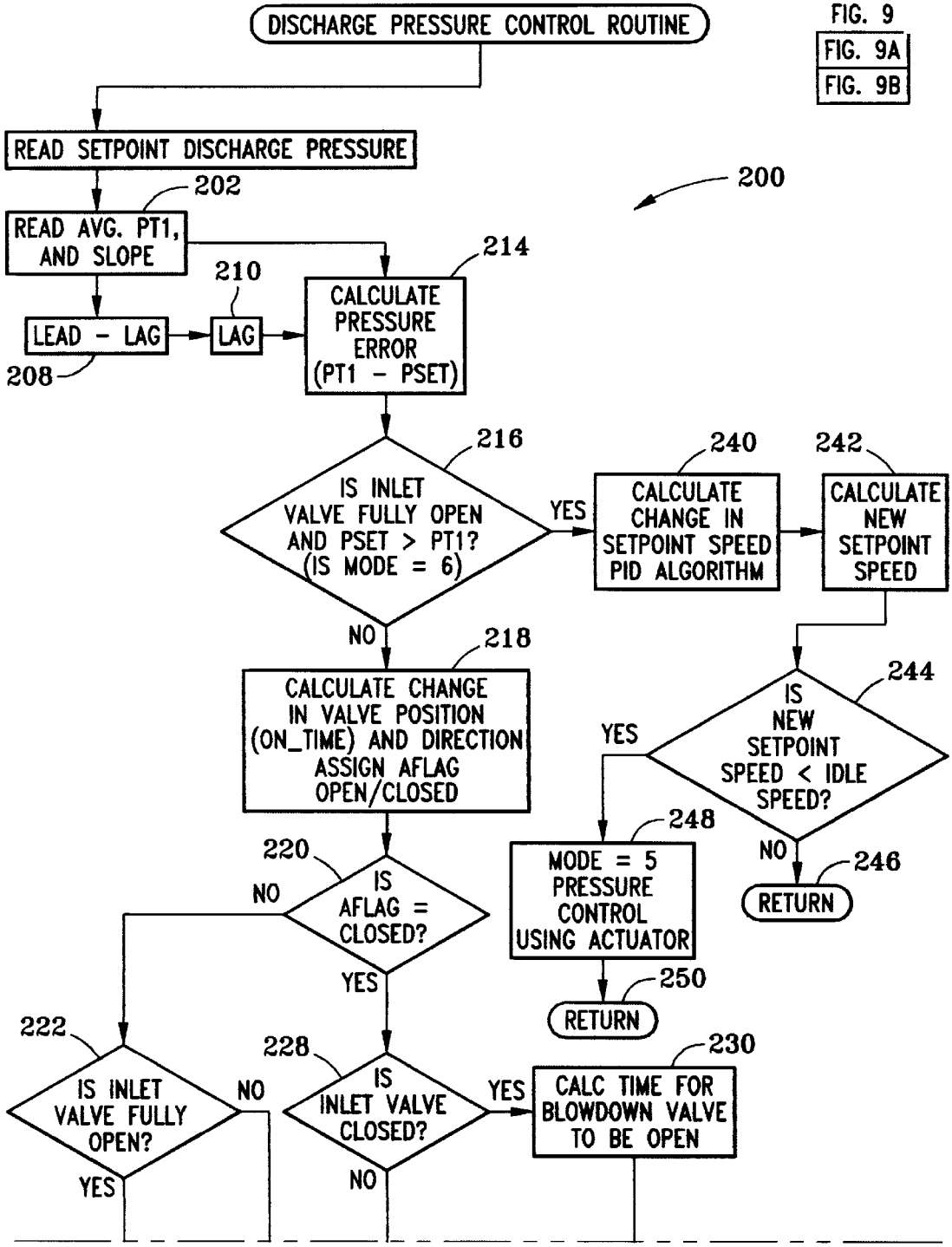
FIG. 9 is a flowchart illustrating the discharge pressure control routine, identified as step 200 in the interrupt control routine of FIG. 7.
Figure 9B:
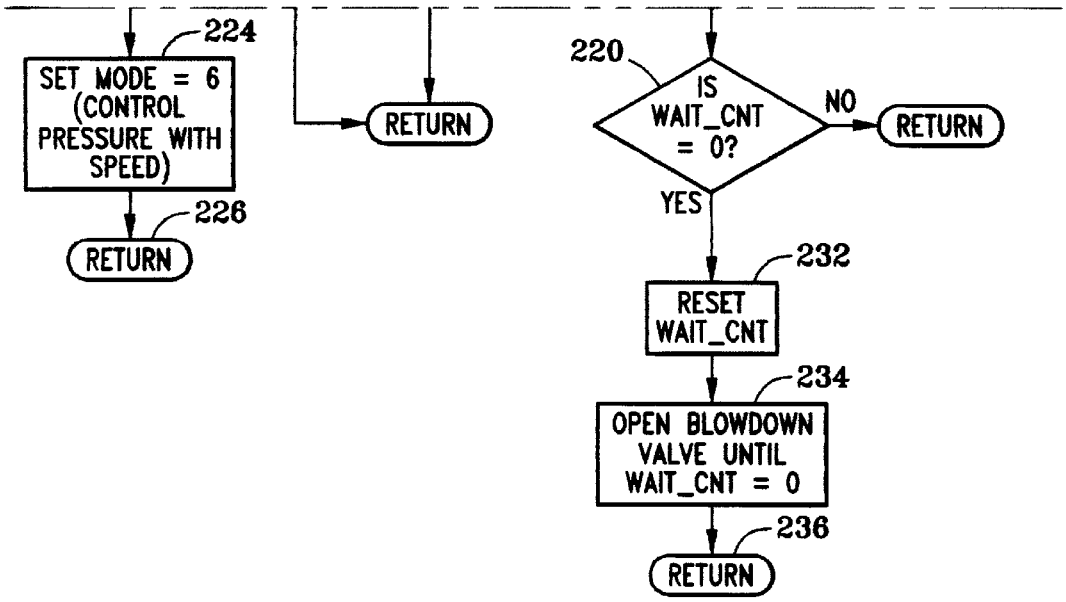

Discharge pressure control routine 200 is illustrated in FIG. 9 and allows for independent control of the prime mover 14 setpoint speed, and positioning of the inlet valve 26, in order to effect the actual discharge pressure of the compressor 10.

In conventional compressors, the speed of the prime mover and position of the inlet valve are linked together. The inlet valve position and prime mover speed are adjusted together to produce the required setpoint discharge pressure. This dependency can limit a compressor operator's ability to produce the required discharge pressure.

Now turning to the flowchart of FIG. 9 which shows the discharge pressure control routine identified generally at 200, the discharge pressure control routine serves to control discharge pressure by either repositioning the position of the inlet valve or by changing the speed of the prime mover.

Initially, in steps 202 and 204, the measured average discharge pressure, PT1; slope, PTLSLOPE; and the setpoint discharge pressure are read from the controller memory 43*a*. The measured average discharge pressure and slope are stored in memory during the sensor scan routine 152 and the setpoint discharge pressure is stored in memory via operator input at the control panel 60.

Then in step 208 a lead-lag routine is executed. Lead-lag routines are well known to one skilled in the art. The lead-lag routine improves response of the control system. In step 210, a conventional lag routine is executed, in order to ramp the setpoint pressure.

In step 214, the discharge pressure error is computed by subtracting the measured average discharge pressure, PT1, from the setpoint pressure, PSET. If the discharge pressure is not equal to the setpoint pressure or within an acceptable deadband range, ±1 psi for example, and the inlet valve 26 is not fully open, the control routine will produce the required discharge pressure by repositioning the inlet valve. Otherwise, the routine will effect the discharge pressure by changing the speed of the prime mover. See step 216.

In step 218, the required change in valve position and direction of change (open or close) are computed using the following proportional integral derivative ("PID") algorithm:

$$\Delta\text{valve position}=D*Perr+E*PT1SLOPE$$

where D and E are constants, the values of which are determined empirically; and Perr=pressure error computed as (actual pressure−setpoint pressure).

The value of "Δvalve position" has a magnitude and positive or negative sign convention indicating the direction the valve needs to be moved to produce the required setpoint discharge pressure. For example, a positive sign convention may indicate the valve needs to be opened while a negative sign convention means the valve needs to be closed.

In step 218, based on the positive or negative sign of Δvalve position, a directional flag referred to as AFLAG is set equal to "open" or "closed". The AFLAG value is used to drive the actuator motor in the required direction in routine 170.

Also in step 218, a variable ON_TIME is assigned a value that corresponds to the amount of time the linear actuator motor 11 must be energized in order to move the valve the required distance equal to "Δvalve position".

In step 220, if it is determined the valve needs to be opened to increase discharge pressure (AFLAG=open), and if in step 222 it is determined that the inlet valve 26 is fully open, the program mode is set to 6 and the discharge pressure is altered by changing the prime mover setpoint speed the next time the speed control routine 300 is executed. The routine then returns to the interrupt control routine 150 in step 226.

Returning now to step 222, if the valve needs to be opened and the valve is not fully open, the valve is opened by energizing the motor, in the required direction, for a period equal to ON_TIME. This method will be further described in conjunction with routines 160 and 170.

Returning to step 220, if it is necessary to close the inlet valve in step 220, and the inlet valve is not already fully closed, the inlet valve is repositioned by energizing the actuator motor, in the required closed direction, for a period equal to ON_TIME. This method will be further described in conjunction with routines 160 and 170.

If the valve is already fully closed, the blowdown valve 39 will be opened by the controller for a predetermined period of time calculated in step 230. After the blowdown valve is closed, the system allows the compressor to settle by waiting for the counter WAIT_CNT to zero out. In step 232, before opening the blowdown valve, the WAIT_CNT is reset to a predetermined value. Then in step 234, the blowdown valve is opened and closed and the system does not reopen the blowdown valve until the WAIT_CNT zeros out.

Returning to decision block 216, if the inlet valve is fully open and the setpoint pressure is different from the measured discharge pressure, the control routine will produce the required discharge pressure by changing the prime mover setpoint speed.

In step 240, the change in the setpoint speed is computed by as follows:

$$\Delta\text{set point speed}=A*Perr+B*PT1SLOPE$$

where Perr and PT1SLOPE are as previously defined hereinabove and A and B are empirically determined constants.

Then the new setpoint speed is calculated in step 242 by adding or subtracting the value obtained in step 240 to the current setpoint speed stored in memory. The new setpoint speed value is then stored in memory and is compared to the idle speed for the compressor. See step 244. If the idle speed is less than the new setpoint speed, the routine returns directly to the 25 msec interrupt control routine.

If the new set point speed is less than the idle speed, the routine sets the operating mode equal to 5 which corresponds to a condition whereby discharge pressure is controlled by repositioning the valve. The routine then returns to the interrupt routine 150 in step 250. The next time the routine 200 is executed and executes decision block 216, the mode will be equal to 5 and the system will proceed directly to block 218.

5 msec Interrupt Control Routine

Referring to FIGS. 12 and 13, like 25 msec Interrupt Control Routine 150 which occurs every 25 msec regardless of the location in routine 90, 5 msec Interrupt Control Routine 160 is executed every 5 msec regardless of the location in routine 90. For that reason, the routine 160 is shown in dashed font in FIG. 4.

The 5 msec Interrupt Routine calls Actuator Position Control Routine 170, in step 162. Routine 170 is shown in FIG. 13. The routine 170, is a hardware driver routine that drives the motor for the actuator that opens and closes the inlet valve 26. The Actuator Position Routine repositions the inlet valve based on the values of ON_TIME and AFLAG received from the Discharge Pressure Control Routine. All decisions regarding direction and energizing time are made in routine 200. The routine energizes the actuator motor for 5 msec intervals until the actuator motor has been energized for ON_TIME. When the routine 170 is executed, SECNT is set equal to ON_TIME. The SECNT is decremented in step 166 of routine 160 each time the 5 msec interrupt is executed, until the SECNT is equal to zero.

Now turning to routine 170, in FIG. 13, the value of AFLAG is determined in decision blocks 172, 174, 176, and 178 which determine if the AFLAG is equal to open, closed, brake or stop. AFLAG is set equal to brake after the actuator motor has been energized for a period equal to ON_TIME. AFLAG is set equal to stop when a repositioning is finished. If AFLAG is equal to stop, the actuator motor is turned off in step 198.

If AFLAG is equal to open, and if SECNT is not equal to zero, the actuator motor is energized for the 5 msec duration of routine 170. The routine 170 returns to routine 90 at the end of 5 msec in step 184. This branch of the routine 170 is repeated until SECNT is decremented to zero. When SECNT is zero, AFLAG is set equal to brake and SECNT is set equal to a braking interval, 25 milliseconds for example. Then, when the routine 170 reaches decision block 176 a braking pulse is transmitted to the motor in step 190. The braking pulse is equal in magnitude and opposite in direction to the ON_TIME energizing pulse. The braking pulse is sent to the motor until SECNT runs down to zero.

The braking pulse time interval is not equal in duration to the ON_TIME energizing pulse time interval. For example, if the ON_TIME energizing pulse has a magnitude of 24 v and lasts for a total of 25 msec, the braking pulse would be −24 volts and may have a duration of 5 or 10 msec. The braking pulse counteracts the momentum of the motor and thereby effectively and precisely brakes the motor. This pulsation method of repositioning the valve is distinguishable from movement by conventional stepper motors.

After the motor is braked, AFLAG is set equal to stop and the system pauses for an empirically determined period of time referred to as "system dead time", step 193. The system dead time is counted down by a conventional counter in the logic routine. During the system dead time, which varies based on the discharge capacity of the compressor, the compressor is given a chance to "settle" and adjust to the new compressor valve setting before changing the valve position again. Once the system dead time has expired, the routine returns to routine 90.

If AFLAG is equal to closed, the motor is energized and braked in the manner previously described in conjunction with opening the valve. The closing steps are identified as steps 192, 194, and 196.

Alert/Shutdown Routine

Figure 10:
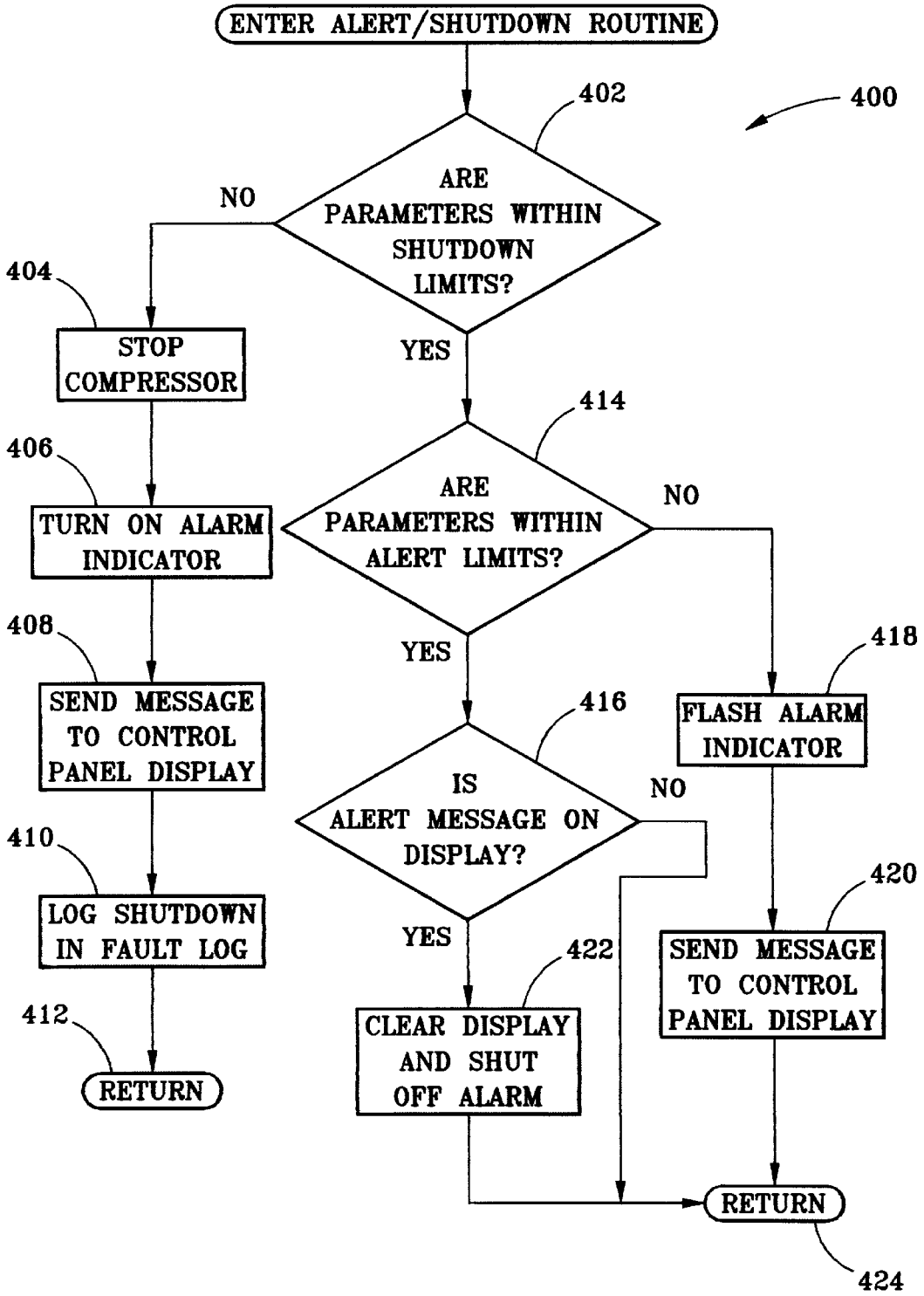
FIG. 10 is a flowchart illustrating the alert/shutdown routine, identified as step 400 in the flowchart of FIG. 4.

The compressor control system includes an alert/shutdown routine generally referred to at 400 in FIG. 10. Generally, in the alert/shutdown routine, a number of the compressor operating parameters are compared with predetermined alert and shutdown limits and if the parameters are outside the alert and shutdown limits, the operator will be alerted of a problem or the compressor will be shutdown. The parameters analyzed during alert/shutdown module 400 are airend discharge pressure, discharge temperature, prime mover speed, prime mover coolant temperature, airend lubricant temperature, and prime mover lubricant pressure. For purposes of describing the preferred embodiment, only the airend discharge temperature and prime mover coolant temperature have alert and shutdown limits. The balance of the parameters only operate under shutdown limits. However, these parameters could also operate with associated alert limits if required.

In step 402 of routine 400, the sensed values for the operating parameters associated with each sensor that were stored in ECM memory in the scan sensors step of interrupt control routine 150 are compared with shutdown limits for the parameters. If the parameters are not outside of the shutdown limits, the routine proceeds to step 414.

If one of the operating parameters is outside its respective shutdown limit, the compressor is shutdown in step 404 by shutdown routine 500. The compressor is shutdown when either the actual prime mover speed or prime mover lubricant pressure is higher or lower than the shutdown limits, and the compressor is shutdown when either the discharge temperature, compressor lubricant temperature or engine coolant temperature is only above the shutdown limits. For these parameters, the compressor does not shutdown when the parameters are below the shutdown limits.

When the compressor is shutdown, the display panel alarm indicator 80 is illuminated in step 406 and remains continuously illuminated until the shutdown condition is corrected. Additionally, in step 408 a message is displayed in display window 62 describing the shutdown condition. The message remains displayed in window 62 until the shutdown condition is corrected.

In step 410, the shutdown condition is logged in the ECM fault log and is stored in the ECM memory. The routine 400 then returns to the main program in step 412.

If none of the parameters are outside the shutdown limits the module proceeds to step 414. In step 414, the sensed values for the airend lubricant and prime mover coolant temperatures by sensors 49 and 46 are compared with associated temperature alert limits. If the actual temperatures are within the alert limits and there is not a message on the panel display, the module returns to main routine 90. However, if the temperatures are outside the alert limits, the display panel alarm indicator 80 is illuminated intermittently in step 418, to attract the attention of the compressor operator and, in step 420 a message is displayed in window 62 indicating the nature of the alert condition.

If, after an alert condition occurs, the sensed valves return to a state within the alert limits, the alarm indicator stops flashing and the message is removed from the display window in step 422. The routine 400 then returns to the main routine in step 424.

In addition to the coolant temperature and lubricant temperature, battery voltage and fuel level may also be monitored by the alert/shutdown routine. As the fuel level and battery voltage fall to levels outside of the respective alert limits, the compressor operator would be alerted of the condition in the manner previously described.

Compressor Shutdown Routine

Figure 11:
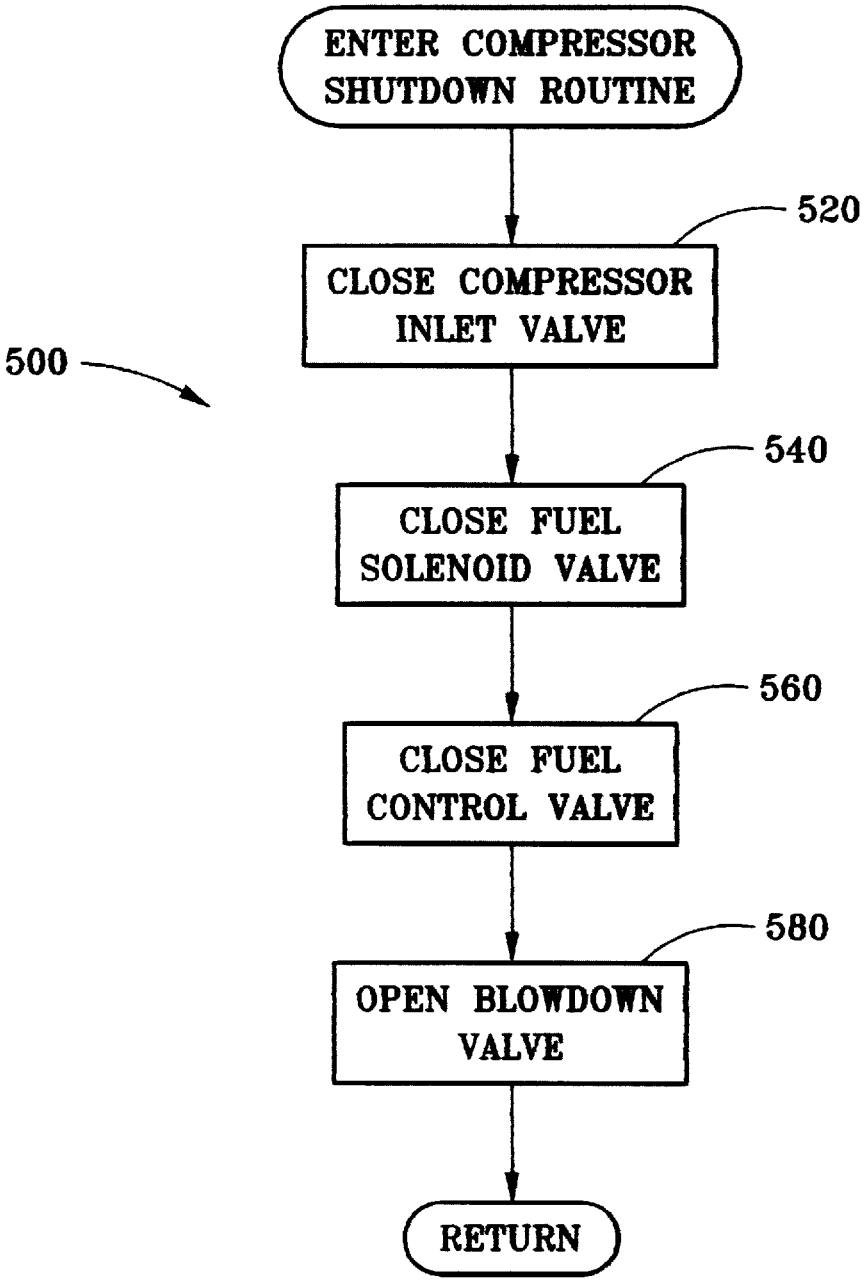
FIG. 11 is a flowchart illustrating the compressor shutdown routine, identified as step 500 in the flowchart of FIG. 4.

When it is necessary to shutdown the compressor either due to a sensed shutdown state or because the Stop button has been actuated by the compressor operator, the compressor shutdown module generally referred to at 500 in FIG. 11 is executed. The compressor shutdown module is generally comprised of steps 520, 540, 560, and 580 which include the following functions. In step 520, the compressor inlet valve 26 is closed by sending a signal from the ECM to the inlet valve actuator. Then in steps 540 and 560 respectively the fuel solenoid valve 35 and fuel control valve 29 are closed. Finally in step 580, the blowdown valve 39 is opened.

In each of the steps of routine 500, the ECM sends a signal to the solenoid or switch associated with the valve and thereby opens or closes the respective valve.

Ether Injection

At low ambient temperatures, the compressor prime mover 14 can be difficult to start. In such ambient conditions, the ether button 72 on control panel 60 may be pressed to open the ether valve 25 to flow a discrete volume of ether from tank 27 into the prime mover and thereby help to start the prime mover. Each time button 72 is actuated, the ether valve is opened and a fixed volume of ether is released into the prime mover.

However in order to prevent injection of an excess volume of ether into prime mover 14, the ECM monitors the release of ether into the prime mover and will only permit a predetermined number of dispensations of ether into the prime mover per unit time. For example, the ECM may be programmed so that ether may only be injected into the prime mover 10 times in any 60-second period. Once this maximum is reached, the ECM disables the ether button preventing further the release of ether into the prime mover. After a predetermined period of time expires, the button is again enabled and ether may again be injected into the prime mover.

Antirumble Valve

During operation of the compressor 10 when the compressor is operating at idle speed (1200 rpm) and the inlet valve 26 is substantially closed so that the compressor is substantially unloaded, the ECM 42 actuates the antirumble valve 28 so that fluid flowed out compressor 12 is recirculated through conduit 15 and ARV 28 back into the compressor. In this way, vibration of the rotors frequently present at high inlet vacuum and reduced compressor load, known to those skilled in the art as "rumble" is eliminated.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A method for controlling discharge pressure in a compressor comprising a compression module driven by a prime mover, the compression module including an inlet valve positionable by a linear actuator that is driven by a motor movable in first and second directions, a discharge port having a discharge pressure sensor proximate the discharge port, said compressor having a setpoint discharge pressure and an actual discharge pressure sensed by the discharge pressure sensor; an electronic control module, in signal receiving relation with the discharge pressure sensor, and in signal transmitting relation with the motor, the electronic control module including a logic routine; the method comprising the following steps:

A) executing the logic routine, the routine comprised of the following steps:
   i) sensing the actual discharge pressure;
   ii) calculating the difference between the actual discharge pressure and the setpoint discharge pressure;
   iii) determining whether the inlet valve is in the open position and the setpoint pressure is greater than the actual pressure and if either the inlet valve is not in the open or the setpoint pressure is less than the actual pressure, executing the steps of:
      a) calculating the distance the inlet valve needs to be repositioned to produce the required discharge pressure, and the direction the inlet valve needs to be moved;
      b) transmitting at least one energizing pulse from the electronic control module to the motor to move the motor in a first direction; and
      c) after the last at least one energizing pulse is transmitted to the motor, transmitting a braking pulse from the electronic control module to counteract movement of the motor in the first direction.

2. The method as claimed in claim 1 wherein each of the at least one energizing pulses has a duration, and the braking pulse has a duration that is less than the duration of the at least one energizing pulse.

3. The method as claimed in claim 1 comprising the step of assigning an ON_TIME variable a value equal to the time the actuator motor needs to be energized to reposition the inlet valve the required amount.

4. The method as claimed in claim 2 wherein the duration of the energizing pulse is 5 milliseconds.

5. The method as claimed in claim 1 comprising the additional step of before step (A)(iii)(a), determining whether the valve is to be moved to the closed position and whether the inlet valve is closed, and then initiating step (A)(iii)(a) if the valve is to be closed and the inlet valve is not already in the closed position.

6. The method as claimed in claim 5, wherein the compressor includes a blowdown valve, the method further including the step of opening the blowdown valve if the valve is to be moved to the closed position and the inlet valve is closed.

7. The method as claimed in claim 6, the method including the further step of calculating the period of time that the blowdown valve is to be opened before opening the blowdown valve.

8. The method as claimed in claim 7, the method including the step of resetting the counter equal to the calculated period of time, the method including the further step of keeping the blowdown valve open until the counter equals zero.

9. The method as claimed in claim 1 comprising the additional step of after the braking pulse is transmitted, before exiting the routine, pausing for a predetermined system dead time.

10. The method as claimed in claim 1 wherein if the inlet valve is fully open and the setpoint discharge pressure is greater than the actual discharge pressure, executing the steps of:

vi) calculating the change in prime mover setpoint speed; and vii) calculating a new setpoint speed.

11. The method as claimed in claim 1 wherein the compressor includes a blowdown valve having a valve actuating means in signal receiving relation with the electronic control module, the method including the step of, if it is necessary to close the inlet valve and the inlet valve is closed, calculating a time period for opening the blowdown valve; opening the blowdown valve for the calculated period of time and waiting to exit the routine until a wait counter has zeroed out.

12. The method as claimed in claim 1 wherein the discharge pressure control routine is run at regular intervals.

13. The method as claimed in claim 12 wherein the regular intervals are 25 milliseconds.

14. The method as claimed in claim 1 wherein the compressor is an oil flooded rotary compressor.

15. A method for controlling compressor discharge pressure in a compressor, the compressor comprising a compression module driven by a prime mover, the compression module having a discharge port through which a compressed fluid is discharged with a discharge pressure, and an inlet through which uncompressed fluid is flowed into the compression chamber, the flow of fluid through the inlet controlled by an inlet valve repositionable by an actuator driven by motor means, the method comprising the steps of:

A) running a discharge pressure control routine, comprising the steps of:

i) calculating the difference between the actual discharge pressure and a predetermined setpoint discharge pressure;

ii) computing the required change in valve position to achieve the setpoint discharge pressure, the period of time the motor means must be energized to produce the change in valve position, and the direction the valve must be moved to produce the setpoint discharge pressure; and B) running an actuator position control routine, comprising the steps of:

i) energizing the motor means in the required direction for the computed period of time; and ii) braking the motor means by energizing the motor means in a direction different than the required direction for a braking time interval.

16. The method as claimed in claim 15 comprising the step of in step A), assigning a value of open, close, stop or brake to AFLAG.

17. The method as claimed in claim 16 comprising the step of in step B) determining the value of AFLAG.

18. The method as claimed in claim 15 comprising the further step of in step B) setting a counter equal to the period of time the motor means is to be energized.

19. The method as claimed in claim 18, comprising the step of braking the motor means after the counter has counted to zero.

20. A method for controlling discharge pressure in a compressor, the compressor comprising a compression module driven by a prime mover, the compression module including an inlet valve positionable between an open position and a closed position and positions therebetween by a linear actuator that is driven by a motor movable in first and second directions, a discharge port having a discharge pressure sensor proximate the discharge port, said compressor having a setpoint discharge pressure and an actual discharge pressure sensed by the discharge pressure sensor; an electronic control module, in signal receiving relation with the discharge pressure sensor, and in signal transmitting relation with the motor and the inlet valve position sensor, the electronic control module including a logic routine comprised of a discharge pressure control routine; the method comprising the following steps:

A) running the discharge pressure control routine, the control routine comprised of the following steps:

i) sensing the actual discharge pressure;

ii) calculating the difference between the actual discharge pressure and the setpoint discharge pressure;

iii) determining whether the inlet valve is in the open position and the setpoint pressure is greater than the actual pressure and if either the inlet valve is not in the open or the setpoint pressure is less than the actual pressure, executing the steps of:

a) calculating the distance the inlet valve needs to be repositioned to produce the required discharge pressure, and the direction the valve needs to be moved;

b) transmitting at least one energizing pulse from the electronic control module to the motor to move the motor in a first direction; and c) after the last at least one energizing pulse is transmitted to the motor, transmitting a braking pulse from the electronic control module to the motor to move the motor in the second direction;

vi) if the inlet valve is fully open and the setpoint discharge pressure is greater than the actual discharge pressure, changing the discharge pressure by effecting the prime mover speed by executing the steps of: calculating the change in prime mover setpoint speed; and calculating a new prime mover setpoint speed.

21. The method as claimed in claim 20 wherein the change in setpoint speed is calculated using a PID algorithm.

* * * * *